US006075839A

United States Patent [19]

Treseder

[11] Patent Number: 6,075,839

[45] Date of Patent: Jun. 13, 2000

[54] AIR COOLED END-WINDOW METAL-CERAMIC X-RAY TUBE FOR LOWER POWER XRF APPLICATIONS

[75] Inventor: Robert C. Treseder, Salt Lake City, Utah

[73] Assignee: Varian Medical Systems, Inc., Palo Alto, Calif.

[21] Appl. No.: 08/921,830

[22] Filed: Sep. 2, 1997

[51] Int. Cl.[7] ..... H01J 5/18

[52] U.S. Cl. ..... 378/140; 378/136

[58] Field of Search ..... 378/137, 124, 378/140, 141, 136

[56] References Cited

U.S. PATENT DOCUMENTS

| | | | |
|---|---|---|---|
| 4,064,411 | 12/1977 | Iwasaki et al. | 378/141 |
| 5,367,553 | 11/1994 | Van Enschut et al. | 378/137 |

FOREIGN PATENT DOCUMENTS

| | | |
|---|---|---|
| 0 439 852 | 8/1991 | European Pat. Off. . |
| 0 553 913 | 8/1993 | European Pat. Off. . |
| 27 49 856 | 5/1979 | Germany . |
| 195 16 831 | 11/1996 | Germany . |

OTHER PUBLICATIONS

"KM16010E–A MicroFocus X–Ray Tube 160 kV", brochure of *Kevex X–Ray, Inc.*, published Jan. 1995.

*Primary Examiner*—Craig E. Church
*Attorney, Agent, or Firm*—Bradford L. Friedman; Bella Fishman; David W. O'Bryant

[57] ABSTRACT

An X-ray tube device and a method for construction thereof which provides the cathode assembly and the anode assembly in a nose of the X-ray tube, wherein an emitter face of each assembly is directed toward an X-ray emission end thereof. The electrons emitted from the cathode assembly travel along a path outward until striking the anode assembly which then generates the X-rays which are directed toward a beryllium window in the X-ray tube. This advantageous structure enables the anode-to-window distance to be small, resulting in a large X-ray flux towards a sample. Furthermore, the small nose of the X-ray tube enables a fluorescence detector to be positioned in an optimal location because the X-ray tube's shape does not displace the fluorescence detector.

20 Claims, 6 Drawing Sheets

AIR COOLED END-WINDOW METAL-CERAMIC X-RAY TUBE FOR LOWER POWER XRF APPLICATIONS

BACKGROUND

1. The Field Of The Invention

The present invention relates generally to X-ray tube technology. More specifically, this invention pertains to a new configuration for a low power X-ray source for an X-ray fluorescence instrument having an air-cooled and metal-ceramic design which provides for a higher flux of X-rays as compared with X-ray tubes of similar power input. Most advantageously, the configuration of the cathode assembly and the anode assembly is such that a small nose at the end-window is provided, thereby enabling the X-ray source to be close to a sample being irradiated.

2. The State Of The Art

In many typical state of the art X-ray tubes, a cathode assembly and an anode assembly are vacuum sealed in a glass envelope. Electrons are generated by at least one cathode filament in the cathode assembly. These electrons are accelerated toward the anode assembly by a high voltage electrical field. The high energy electrons generate X-rays upon impact with the anode assembly. An unavoidable by-product of this process is the generation of substantial amounts of heat. It is important to the life of the X-ray tube to dissipate the heat as efficiently as possible.

The X-ray tube described above is mounted within a housing for protecting the surrounding environment from unwanted X-rays. A state of the art method for cooling the X-ray tube is to fill the housing with oil. The oil not only provides electrical insulation, but it also absorbs the heat generated by the anode assembly. The requirement of an oil pump and hoses also results in lower system reliability, the possibility of leaks and fire, as well as extra cost. Oil cooling also makes repair and maintenance of the X-ray tube more difficult.

Alternatives have been developed to use in place of oil. For example, although sulfur hexaflouride (SF6) is preferable to oil for various reasons, it is expensive, difficult to handle safely, and it can reduce a high voltage standoff capability when it leaks.

An important feature of an X-ray tube utilized in X-ray fluorescence (XRF) is that the X-ray source be as close as possible to a subject or sample being irradiated. The result of X-rays being absorbed by the sample is that it fluoresces. A detector of fluorescent energy is then disposed near to the sample at a desired angle relative to the sample and the X-ray source. The desired angle typically enables the maximum amount of fluorescent energy to be received by the fluorescent energy detector.

X-ray tubes which are utilized in X-ray fluorescence instruments are typically characterized as being one of three different X-ray tube configurations. These X-ray tube configurations are known as a transmission tube design having an end-window from which X-ray energy is directed toward a sample, and a side-window configuration.

There are inherent drawbacks to each X-ray tube design which hinder their performance in XRF instruments. The components of the transmission tube 10 which are of relevance to the present invention are illustrated in general in FIG. 1. FIG. 1 shows that a housing 12 surrounds a cathode assembly 14. The cathode assembly 14 is centered behind an anode/window combination 16. In this way, a high voltage field developed between the cathode assembly 14 and the anode/window 16 causes electrons 18 emitted from a filament (not shown) in the cathode assembly 14 to flow directly toward the anode/window 16. For example, the anode/window 16 can be coated with an anode-type material. The electron flux 18 striking the anode/window 16 causes the generation of X-rays 20. The usable X-rays 21 continue out through the anode/window 16. Accordingly, instead of electrons 18 striking an anode and the resulting X-rays 20 being deflected therefrom at an angle, the usable X-rays 21 continue on in the same direction as the original flow of electrons 18 from the cathode assembly 14.

There are several disadvantages to this design. First, there are reliability drawbacks. The high voltage stability of a transmission tube is generally not as good as from a side-window X-ray tube design. The anode/window is also constructed differently because of the substantial amount of heat which is generated. This heat imposes a limit on how thin the anode/window can be constructed. Disadvantageously, the X-rays produced on the surface of the anode are substantially attenuated on passing through the entire thickness of the anode window. Consequently, the X-ray emissions are not as strong as they could be.

The end-window tube design has inherent design drawbacks which prevent it from being more useful in an X-ray fluorescence detector. Specifically, the size of the X-ray tube nose interferes with optimum detector placement.

Unfortunately, the side-window X-ray tube also has serious drawbacks which typically prohibit or hinder its application in XRF instruments. These drawbacks stem from the fact that the sample-to-target distance is necessarily large. The distance is large because as shown in the cross section view of an X-ray tube 22 provided in FIG. 2, the X-ray tube itself interferes with the detection of fluorescent energy 24 because a fluorescent energy detector 26 can not be placed in optimal locations. In other words, the sidewall 28 of the X-ray tube 22 absorbs much of the fluorescent energy 24 which would otherwise be detected at the optimal detection angle. However, moving the side-window X-ray tube further from the sample simply decreases the available X-ray flux at the sample. The available X-ray flux is already inherently small due to the large distance from the target 31 to the sample 30 in the side-window tube.

It is also worth noting that the state of the art X-ray tubes suffer from a relatively short filament life, poor stability and high tube electrical leakage.

Therefore, it would be an advantage over the state of the art to provide an X-ray tube which enabled greater X-ray emissions to reach the sample, and then permit a fluorescent energy detector to be located at an optimal angle of deflection, and with a minimal target-to-sample distance and superior detector-sample coupling.

There are other features in state of the art X-ray tubes, both end-window and side-window designs, which are also disadvantageous. For example, glass is commonly utilized as a high voltage insulator. But the glass is subject to fracture. The glass also results in a less repeatable manufacturing process which increases costs. Glass also prohibits higher temperature tube processing which facilitates the elimination of additional gas from the vacuum envelope in the X-ray tube.

It would be another advantage over the state of the art to replace glass with a more rugged high voltage insulator. It would be further advantageous if the high voltage insulator would then permit higher temperature processing to thereby enhance tube processing to obtain a better vacuum and thus a cleaner X-ray tube. It would also be advantageous to provide an X-ray tube with better heat transfer characteristics which would enable the anode to operate at a lower temperature, and thus extend the operational life of the X-ray tube.

OBJECTS AND SUMMARY OF THE INVENTION

It is an object of the present invention to provide a new method and apparatus for an X-ray tube which is suitable for lower power X-ray fluorescence applications.

It is another object to provide an X-ray tube which utilizes a metal-ceramic high voltage insulator which provides the advantage of a compact design and better overall heat transfer.

It is another object to provide an X-ray tube which provides a new structure and geometry for the electron optics which advantageously results in an end-window design.

It is another object to provide an X-ray tube which eliminates the need for using oil or other electrically insulating or thermally conductive liquid or gaseous material.

It is another object to provide an X-ray tube which employs a forced air-cooled design.

It is another object to provide an X-ray tube which utilizes a potting material which has a boron nitride powder for enhanced thermal conductivity and thus improved heat transfer, while at the same time providing high voltage insulation.

It is another object to provide an X-ray tube which has a higher flux of X-rays for the same input power to an X-ray tube.

It is another object to provide an X-ray tube which has a smaller target-to-window distance resulting in an x-ray source which can be placed closer to a subject.

It is another object to provide an X-ray tube which utilizes the potting material for heat transfer enhancement so that the complexity is reduced in the overall system.

The present invention is realized in an X-ray tube device and a method for construction thereof which places the cathode assembly and the anode assembly in a nose of the X-ray tube, wherein an emitter face of each assembly is directed toward an X-ray emission end thereof. The electrons emitted from the cathode assembly travel along a path outward until striking the anode assembly which then generates the X-rays which are directed toward a beryllium window in the X-ray tube. This advantageous structure enables the target anode-to-window distance to be small, resulting in a large X-ray flux towards a sample. Furthermore, the small nose of the X-ray tube enables a fluorescence detector to be positioned in an optimal location because the X-ray tube's shape does not displace the fluorescence detector. In addition, the window is operated at cathode potential so that no electrons strike and thus heat the window.

In a first aspect of the present invention, a potting material utilized in the construction, which is normally a poor thermal conductor, is modified so as to provide improved thermal conduction. Enhanced cooling of the X-ray tube is then accomplished by cooling an exterior surface of the potting material, such as through forced-air.

In another aspect of the invention, projections or protrusions are formed on the exterior surface of the potting material. Forced-air cooling is thus more effective because of the increased surface area of the potting material which can be cooled.

In another aspect of the present invention, the use of oil as a high voltage insulator and cooling mechanism is replaced with the air-cooled system. Accordingly, the complexity of the overall system and the cost is decreased while reliability is increased.

In another aspect of the invention, the high voltage insulation is increased in length and the diametric spacing between components is increased, advantageously resulting in higher voltage operation of the X-ray tube.

In another aspect of the invention, a second cathode assembly is provided which is separate from the first cathode assembly, thereby providing for dual focal spot capability. Similarly, the filaments could be operated simultaneously for higher X-ray flux emissions.

In another aspect of the invention, an electrode grid can be provided for 1) enhanced control of a focal spot location, 2) enhanced electron emission from the cathode assembly, or achieving control over a size of a focal spot which is other wise unobtainable using a basic electron optic configuration.

In another aspect of the invention, a heat pipe is provided inside the anode assembly to thereby permit higher power operation.

In another aspect of the invention, the heat pipe makes possible the use of alternate target materials having higher vapor pressures which therefore require enhanced cooling for practical use.

In another aspect of the invention, an electrically flashed getter is provided for improved removal of gas molecules from the vacuum envelope of the X-ray tube, thus resulting in a X-ray tube which is cleaner.

In another aspect of the invention, a cathode slot design having a coiled filament is borrowed from medical application X-ray tube designs to provide more efficient electron emission and improved focal spot size repeatability.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The present invention encompasses many improvements in the design of X-ray tubes. However, as previously explained, the presently preferred embodiment of the present invention has particular application to X-ray tubes which are utilized in X-ray fluorescence instruments. This is because one of the important points of novelty of the preferred embodiment is an advantageous arrangement of a cathode assembly and an anode assembly within the X-ray tube.

Figure 1:
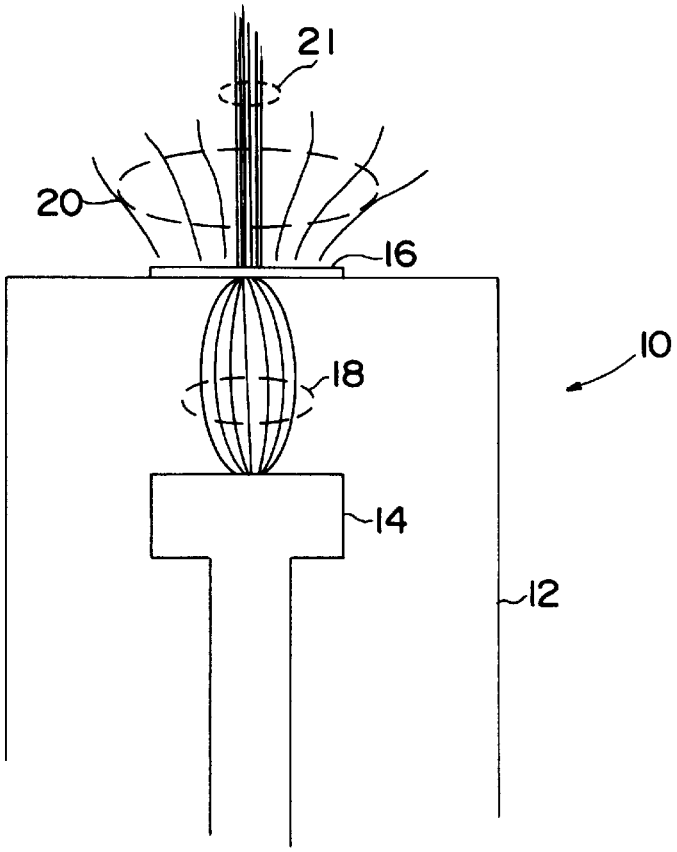
FIG. 1 PRIOR ART
FIG. 1 is a cross-sectional profile view of some of the typical components in an X-ray tube of the prior art, where the design is known as a transmission tube wherein an anode is constructed as part of an X-ray emission end-window.
Figure 2:
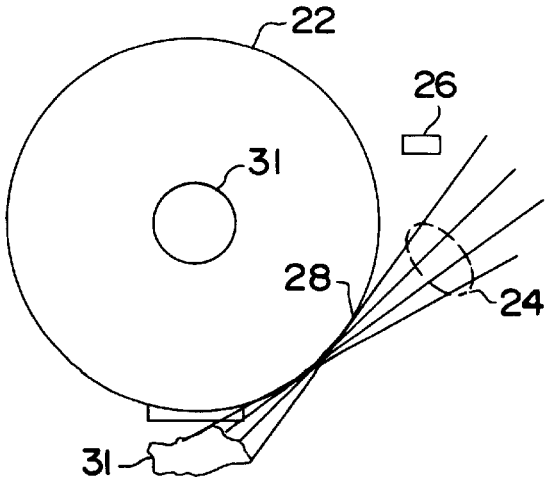
FIG.2 PRIOR ART
FIG. 2 is a cross-sectional end view of a side-window X-ray tube which is also typical of the prior art, and by the very nature of its construction interferes with the detection of energy emitted from a fluorescing sample under observation.
Figure 3:
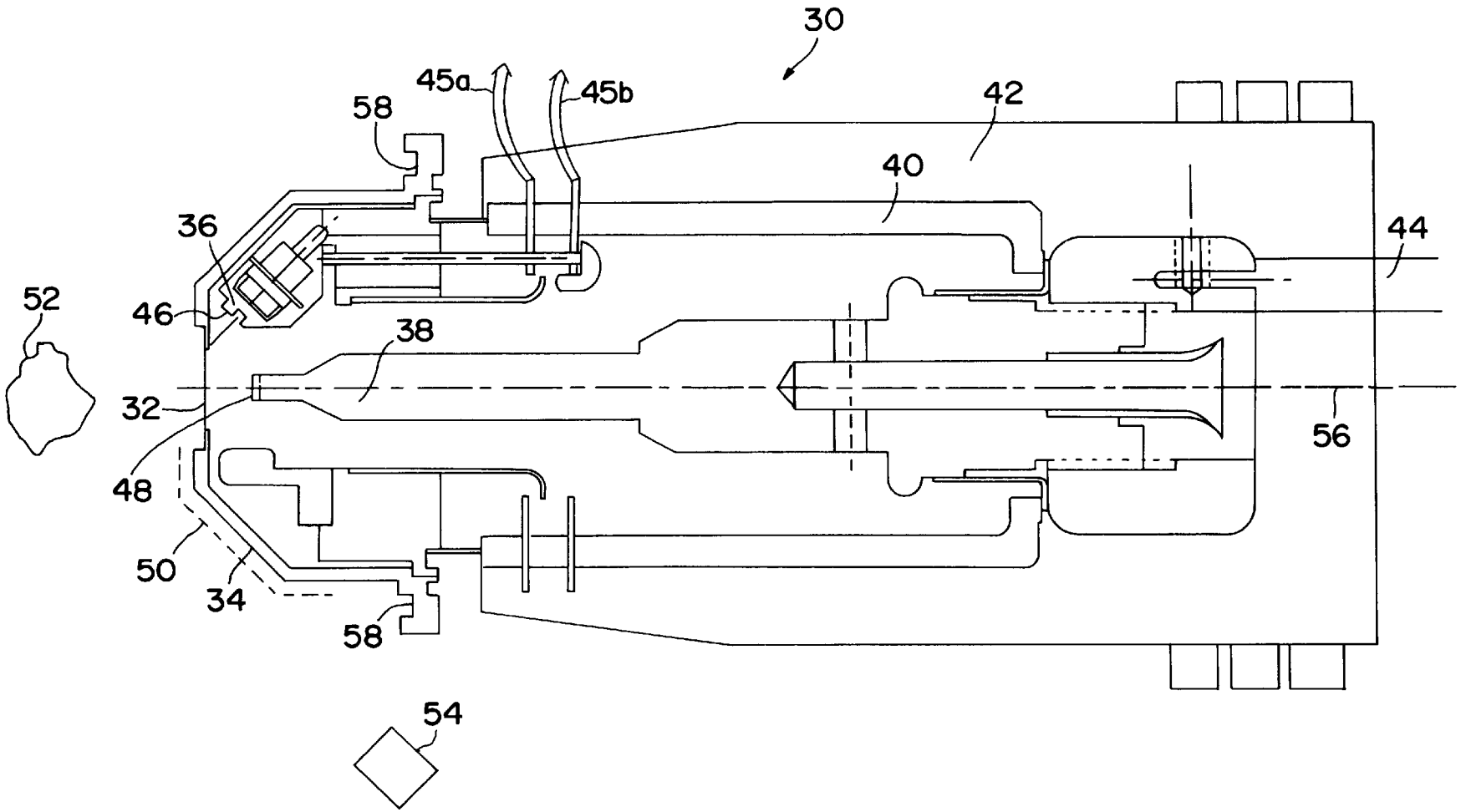
FIG. 3 is a cross-sectional profile view of a presently preferred embodiment made in accordance with the specifications of the present invention.

FIG. 3 shows that the presently preferred embodiment is an X-ray tube 30 which has an end-window configuration. That is to say, an X-ray emission window 32 is disposed at one end of the X-ray tube 30. Housed within a vacuum envelope 34 are a cathode assembly 36 and an anode assembly 38. The vacuum envelope 34 is partially enclosed by a high voltage insulator 40. The high voltage insulator 40 is in turn surrounded by a potting material 42. There are also electrical leads such as the anode lead 44, and at least two filament leads 45*a* and 45*b* which deliver voltages to the anode assembly 38 and the cathode assembly 36, respectively. An o-ring groove 58 is also shown to circumscribe the X-ray tube 30. The o-ring 58 is for providing a seal when the sample 52 is being irradiated within a vacuum chamber (not shown).

The cathode assembly 36 is shown having a very different orientation relative to the anode assembly 38 than is taught in the prior art. Instead of an electron emission face 46 of the cathode assembly 36 being orientated towards an X-ray emission face 48 of the anode assembly 38, both emission faces 46 and 48 are directed toward the X-ray emission window 32.

It should be remembered that the purpose for this orientation of emission faces 46 and 48 is to obtain as small a nose as possible. The nose of this X-ray tube 30 is defined generally by the dotted line 50. Specifically, it is that portion of the X-ray tube 30 which is closest to a sample 52 being irradiated and which can interfere with or block energy being radiated from the sample. In other words, information is derived from an irradiated sample 52 by monitoring and detecting energy which is fluorescing therefrom. Accordingly, at least one energy detector 54 is disposed near the sample 52 as shown.

It has been determined that one optimal angle for energy detection is at approximately a forty five degree angle relative to an X-ray tube axis 56. Therefore, with the at least one energy detector 54 positioned as shown in FIG. 3, the appropriate angle is obtained. While this explanation shows the end result of the preferred embodiment, some important aspects of implementation are worth examination.

Figure 4:
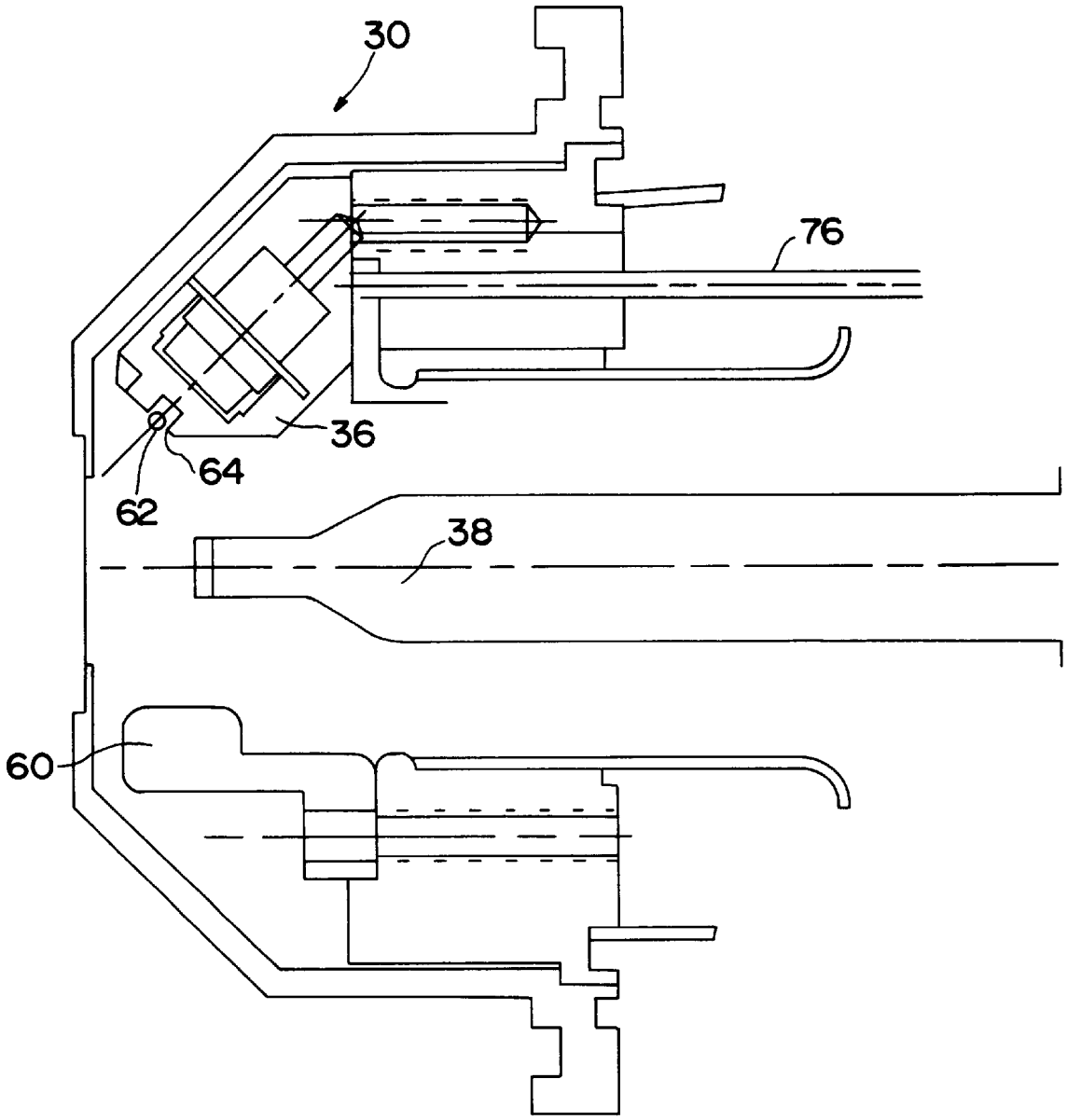
FIG. 4 is a close-up cross-sectional view of the X-ray tube of FIG. 3.

FIG. 4 is a close-up cross-sectional view of the X-ray tube 30 of FIG. 3. This view is helpful in that additional components are easier to identify. Specifically, in addition to the cathode and anode assemblies 36 and 38, there is a shown a focusing electrode 60, an end-view of a cathode filament 62, and a filament lead 76 which provides an electrical contact to the filament.

What is unusual in the preferred embodiment is that the design of the cathode assembly 36 is based on a cathode assembly utilized in medical applications, such as in X-ray tubes used in mammography applications. Mammography cathode assemblies are characterized as having a focusing slot 64 as shown. The focusing slot 64 is designed to focus a width of an electron beam being generated by the cathode filament 62. Often, multi-level slots (also referred to as cathode cups) are utilized in mammography cathode assemblies, however, it has been discovered that the advantages of leaving the cathode filament 62 out of the slot 64 are very desirable. Specifically, the perveance obtained by leaving the cathode filament 62 out of the slot 64 is considerably larger than with mammography tubes. In one such embodiment, a 10mA emission current at 4 kV X-ray tube voltage is achievable at a practical filament temperature.

One particular advantage to the large perveance is that the cathode filament 62 might be able to supply a desired level of electron emissions at a substantially smaller voltage level. Accordingly, the cathode filament 62 can run at a lower temperature. Therefore, the cathode filament 62 lasts longer because there is less evaporation of tungsten, or of whatever material is being used as the cathode filament 62.

Another less obvious advantage is that the placement of a cathode filament 62 in a cathode assembly 36 is much easier than in other cathode assemblies. Furthermore, the cathode filament 62 can be placed much more precisely to obtain more predictable results, even when utilizing a number of different X-ray tubes 30.

Figure 5:
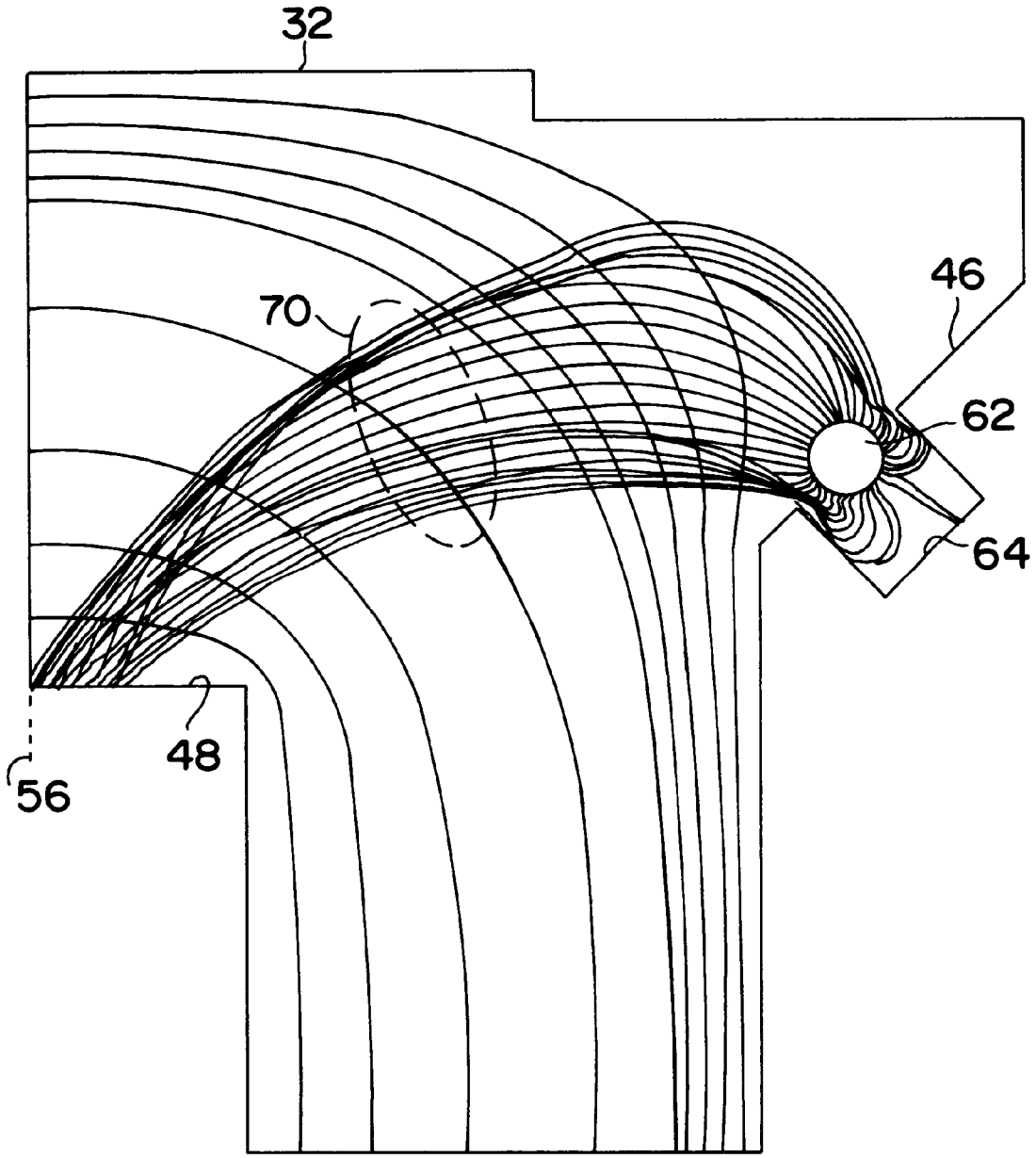
FIG. 5 is a profile of electron beam flux lines which are being emitted from the cathode filament. The electron beam flux lines then strike the anode assembly on the X-ray emission face.

Before addressing the focusing electrode 60, it is best to move ahead to FIG. 5. FIG. 5 is a profile of electron beam flux lines 70 which are being emitted from the cathode filament 62. The electron beam flux lines 70 then strike the anode assembly 38 on the X-ray emission face 48. The number of flux lines shown is only relevant in that the curved path of the electrons is being illustrated from all relevant angles around the cathode filament 62.

The path that the electron beam flux lines 70 must travel is purely a function of the location of the emission faces 46 and 48, and window 32. Nevertheless, it should be realized that to take advantage of the preferred embodiment, the orientation of the cathode assembly 36 and the anode assembly 38 will be such that the electron beam flux lines 70 are going to be curving back toward the X-ray emission face 48. Accordingly, it should be apparent that the cathode assembly is preferably (but not exclusively) going to have its electron emission face directed toward the X-ray emission window 32. Thus, if the cathode assembly is going to be at an angle so that it is providing a smaller nose 50, it is always going to be angled so that the electron beam flux lines 70 must travel along a path which bends at least forty five degrees relative to the X-ray tube axis 56.

In FIG. 5, it should be noted that the cathode 62 filament is disposed partially down into the slot 64. As explained above, while this is certainly allowable, a substantially greater perveance is obtained by lifting the cathode filament 62 generally above a plane formed by the cathode electron emission face 46. Note that this figure does not show the cathode filament 62 raised above the plane of the electron emission face 46.

Figure 6:
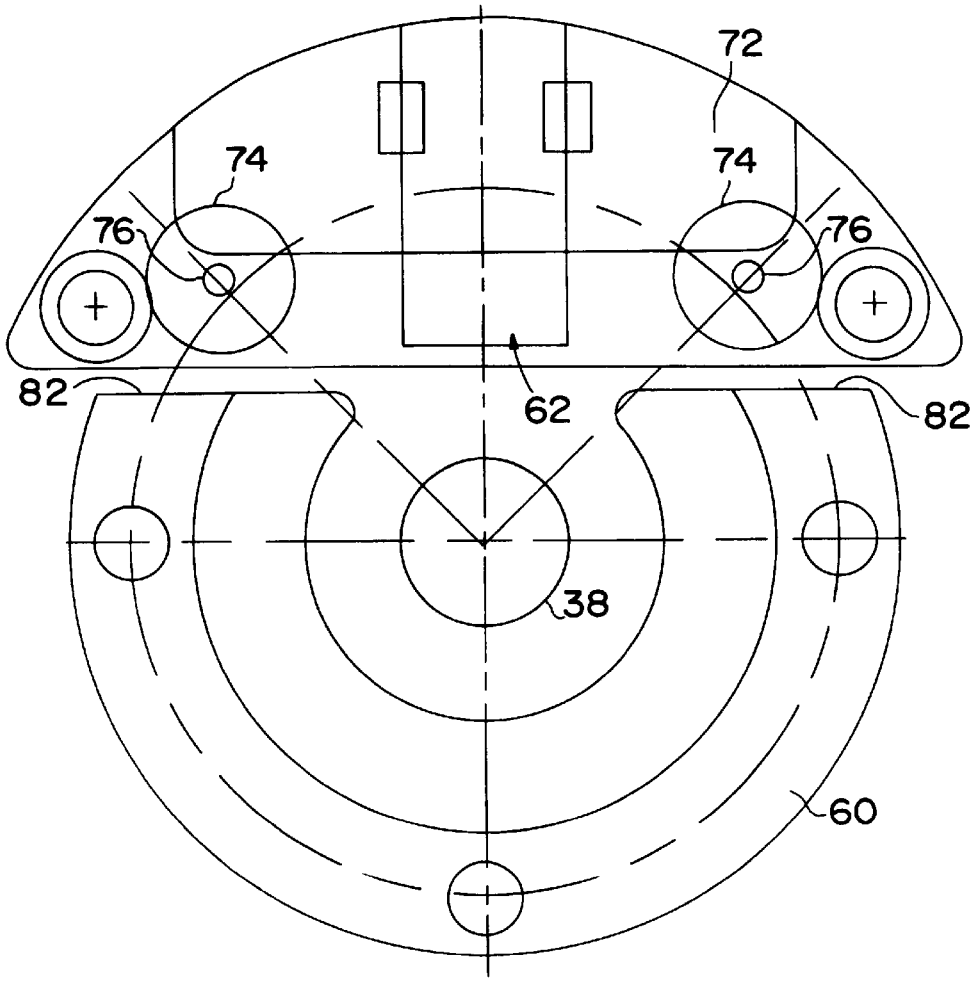
FIG. 6 is provided to show an end-view of a cathode head relative to a focusing electrode.

FIG. 6 is provided to show an end-view of a cathode head 72. The cathode head 72 shows from this angle that there are two holes 74 (seen on their ends) through the cathode head 72. In the center of each hole 74 is a lead 76, where the cathode filament 62 is generally disposed therebetween. Also shown in this end-view is the focusing electrode 60. The distinctive U-shape design of this preferred focusing electrode 60 enables it to bend around the anode assembly 38. The ends 82 of the U-shape terminate just short of physical contact with the cathode 72.

Figure 7:
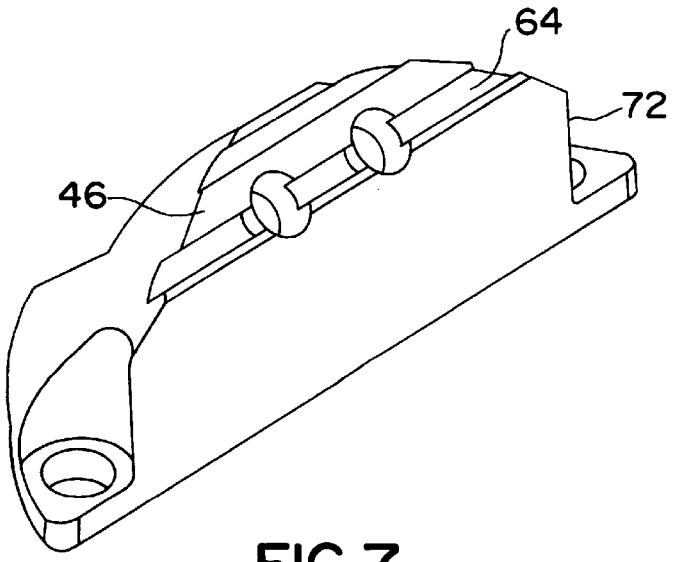
FIG. 7 is an orthogonal view of the cathode head which more readily portrays the angle of the cathode electron emission face, the two lead holes and the focusing slot.

To assist in visualizing the cathode head 72 of FIG. 6, FIG. 7 is also provided. FIG. 7 is an orthogonal view of the cathode head 72 which more readily portrays the angle of the cathode electron emission face 46.

Figure 8:
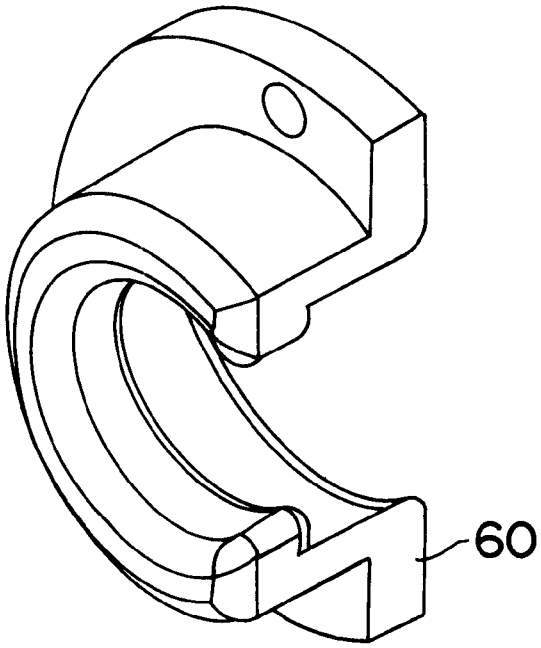
FIG. 8 is an orthogonal view of the focusing electrode which shows the U-shape of the preferred embodiment.

FIG. 8 is provided to also assist in visualizing the focusing electrode 60. FIG. 8 is an orthogonal view of the focusing electrode 60 which shows the U-shape of the preferred embodiment. It should be remembered that a focusing electrode can have any desired shape which accomplishes the type of focusing (length, width, or other) which is desired.

Having described the presently preferred embodiment of the present invention, there are other features which provide significant advantages. For example, the present invention is also directed to a low power application, on the order of 50 watts or less. This low power provides the opportunity to substitute a simpler cooling method for the oil or SF6 used in the prior art. Forced-air cooling can be particularly advantageous because of cost, weight, materials, etc. While forced-air cooling has been used in the prior art, an alternative embodiment of the present invention adapts the X-ray tube to more readily take advantage of air cooling.

Specifically, in a first alternative embodiment, the potting material of the present invention is modified by the addition of a second material. A powder comprised of boron nitride power is added to a typical silicone potting material. Whereas silicone potting is a poor thermal conductor, the boron nitride substantially increases its thermal conductivity. Because typical potting materials are not conductive, any enhancement to an exterior surface of the potting material to thereby increase surface area will have a minimal benefit toward dissipating heat. However, now that the potting material is thermally conductive, the alternative embodiment of the present invention takes advantage of this feature by applying forced-air cooling. More specifically, FIG. 9 shows a plurality of projections which are formed from the potting material and on the exterior surface thereof.

Figure 9:
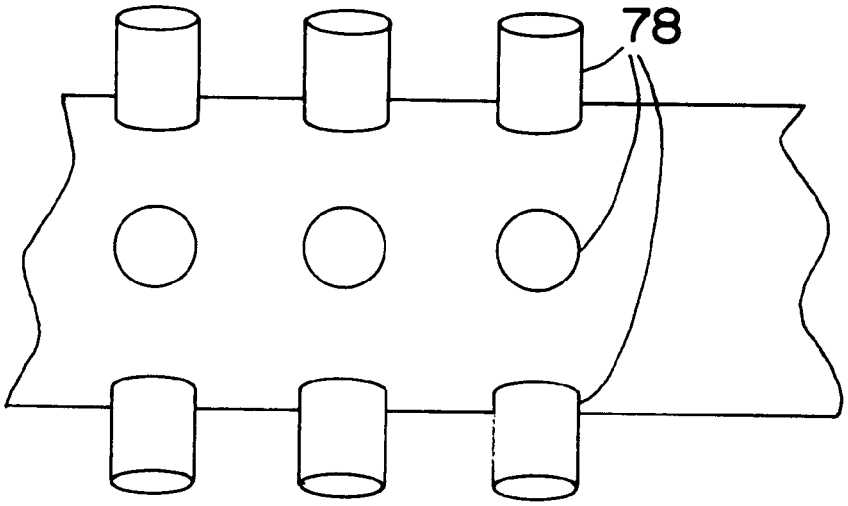
FIG. 9 is a first alternative embodiment showing the projections which are formed of the potting material which has been modified so as to have greater thermal conductivity.

FIG. 9 shows that the projections 78 are preferably cylindrical in shape. This is very simple to put into practice. However, it should be readily apparent that any shape for the projections 78 can be used. Accordingly, a preferred embodiment has three rows of ten projections 78 each. The projections 78 can also be arranged differently, such as in a staggered pattern, with or without regular spacing.

In another aspect of the invention, the presently preferred embodiment teaches that the anode assembly 38 is co-linear and co-axial with the X-ray tube axis 56. However, in an alternative embodiment, it should be realized that these relationships might vary. Thus, the anode assembly 38 might be co-linear but not co-axial and generate an X-ray beam which is off center from the X-ray tube axis 56. Furthermore, the anode assembly 38 might not be co-axial or co-linear.

In another aspect of the invention, it is an alternative embodiment that more than one cathode assembly 36 be provided in the X-ray tube. For example, a diametrically opposite second cathode assembly might be disposed in the vacuum chamber. This would allow for two options to occur. First, the cathode assemblies could be operated at different times, where each cathode assembly has its own focal spot characteristics of size, length, width, etc. Second, the cathode assemblies could be operated simultaneously so as to act to reinforce each other. This could double X-ray emissions, but would require a greater ability to cool the X-ray tube cathode structure.

It is possible to couple a heat pipe to the anode assembly. The heat pipe might also be utilized when it is desirable to utilize different materials for the anode assembly.

In another alternative embodiment of the present invention, an electrical grid can be placed over the electron emission face 46. The electrical grid can have an electrical charge applied thereto, resulting in a modification of the focal spot. This electrical grid can be an alternative means of focal spot characteristics.

In another aspect of the invention, the present invention incorporates an electrically flashed getter. The getter is able to significantly improve the cleanliness of the vacuum chamber within the X-ray tube, thereby enabling improved performance over the life of the X-ray tube.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An X-ray tube which is configured so as to minimize a width thereof by providing a first cathode assembly and an anode assembly which are disposed therein so as to provide a structure which enables the emission of X-rays from the anode assembly which is disposed adjacent to an X-ray emissions end-window, said X-ray tube comprising:

the X-ray emissions end-window which is disposed perpendicular to the longitudinal axis of the X-ray tube;

the first cathode assembly having an electron emission face for generating a plurality of electrons therefrom and a cathode axis being perpendicular relative to the electron emission face and being disposed at about forty five degree angle relative to the longitudinal axis of the X-Ray tube, such that an exterior sidewall of the X-ray tube which is adjacent to the first cathode assembly circumscribes a truncated cone to thereby minimize the spatial dimensions of a nose of the X-ray tube, wherein the electron emission face is directed towards the X-ray emissions end-window; and the anode assembly for receiving the plurality of electrons, and generating as a result thereof a plurality of X-rays from an X-ray emission face which is directed towards the X-ray emissions end-window, and wherein the anode assembly is disposed adjacent to the X-ray emissions end-window.

2. The X-ray tube as defined in claim 1 wherein the X-ray tube further comprises a heat pipe coupled to the anode assembly to provide additional capability for heat conduction to thereby enable higher voltage operation of the anode assembly.

3. The X-ray tube as defined in claim 1 wherein the X-ray tube further comprises an electrical grid disposed adjacent to the first cathode assembly to provide control over focal spot size.

4. The X-ray tube as defined in claim 1 wherein the X-ray tube further comprises an electrical grid disposed adjacent to the first cathode assembly to provide enhanced electron emissions.

5. The X-ray tube as defined in claim 1 wherein the X-ray tube further comprises an electrical grid disposed adjacent to the first cathode assembly to provide focal spot control.

6. The X-ray tube as defined in claim 1 wherein the first cathode assembly further comprises a focusing electrode disposed so as to adjust a length of an electron beam path between the first cathode assembly and the anode assembly.

7. The X-ray tube as defined in claim 6 wherein the focusing electrode is formed generally having a U-shape, where both ends of the focusing electrode are adjacent to the first cathode assembly, and extend generally in a semicircle around the X-ray emission face.

8. The X-ray tube as defined in claim 1 wherein a distance between the anode assembly and the X-ray emissions end-window is less than 8 mm.

9. The X-ray tube as defined in claim 1 wherein the first cathode assembly further comprises:

a cathode filament for generating the plurality of electrons, and which is coiled about a filament axis, wherein the filament axis is parallel to the electron emission face; and a cathode head having a slot parallel to the electron emission face, wherein the cathode filament is disposed so as to be parallel to the slot, and wherein the slot is utilized for focusing a width of an electron beam comprised of the plurality of electrons.

10. The X-ray tube as defined in claim 1 wherein the cathode filament is disposed adjacent to but outside of the slot to thereby increase perveance.

11. The X-ray tube as defined in claim 1 wherein the X-ray tube is utilized in X-ray fluorescence instruments, such that the X-ray emissions end-window is disposed adjacent to a sample to be irradiated, and where the X-ray tube is utilized in conjunction with a fluorescence energy detector disposed adjacent to the X-ray tube so as to detect fluorescent emissions from the sample, and the X-ray tube is fitted with a means for sealing a portion of the X-ray tube into an evacuated chamber, such that fluorescent energy measurements can be taken within the evacuated chamber.

12. The X-ray tube as defined in claim 1 wherein the X-ray tube further comprises a heat pipe coupled to the anode assembly to provide additional capability for heat conduction to thereby enable an alternate material to be utilized in construction of the anode assembly.

13. The X-ray tube as defined in claim 1 wherein a larger anode assembly is provided to replace the original anode assembly, and the diametric spacing between components within the X-ray tube is increased to thereby enable higher voltage operation to thereby produce a higher X-ray flux from the X-ray tube.

14. The X-ray tube as defined in claim 1 wherein a second cathode assembly is disposed within the X-ray tube at a location diametrically opposite to the first cathode assembly to thereby provide a second source of electrons for a dual focal spot capability and the first cathode assembly and the second cathode assembly are operated simultaneously to thereby provide a greater electron flux.

15. The X-ray tube as defined in claim 1 wherein the X-ray tube further comprises an electrically flashed getter for improved removal of gases from a vacuum envelope which is at least partially surrounding the cathode assembly and the anode assembly, to thereby obtain improved performance.

16. The X-ray tube as defined in claim 1 wherein the X-ray tube further comprises:

a high voltage insulator; and a potting material disposed in physical contact with the high voltage insulator, wherein the potting material is combined with at least a second material to thereby increase thermal conductivity of the potting material.

17. The X-ray tube as defined in claim 16 wherein the at least a second material which is combined with the potting material to increase its thermal conductivity is boron nitride.

18. The X-ray tube as defined in claim 16 wherein the high voltage insulator is selected from the group of high voltage insulators consisting of metal and ceramic.

19. The X-ray tube as defined in claim 16 wherein the potting material is formed into a plurality of projections which extend outward from the X-ray tube to thereby substantially increase a surface area of the potting material to thereby increase dissipation of thermal energy which has been conducted to the potting material.

20. The X-ray tube as defined in claim 19 wherein the X-ray tube further comprises a forced-air cooling system which forces air at least over the potting material to thereby increase dissipation of thermal energy which has been conducted to the potting material.

* * * * *